US006116879A

United States Patent [19]

Teraoka

[11] Patent Number: 6,116,879

[45] Date of Patent: Sep. 12, 2000

[54] FLUID MACHINE

[75] Inventor: Masao Teraoka, Tochigi, Japan

[73] Assignee: Tochigi Fuji Sangyo Kabushiki Kaisha, Tochigi-ken, Japan

[21] Appl. No.: 09/251,126

[22] Filed: Feb. 16, 1999

[30] Foreign Application Priority Data

Feb. 17, 1998 [JP] Japan ..... 10-035120

[51] Int. Cl.[7] ..... F04C 2/00

[52] U.S. Cl. ..... 418/191; 418/150

[58] Field of Search ..... 418/191, 150

[56] References Cited

U.S. PATENT DOCUMENTS

| | | | |
|---|---|---|---|
| 4,224,015 | 9/1980 | Nagata | 418/150 |
| 4,666,384 | 5/1987 | Kaga et al. | 418/150 |

FOREIGN PATENT DOCUMENTS

| | | | |
|---|---|---|---|
| 624290 | 7/1961 | Canada | 418/191 |
| 1331495 | 5/1963 | France | 418/191 |
| 0067085 | 12/1976 | Japan | 418/191 |
| 7507350 | 12/1976 | Netherlands | 418/191 |

*Primary Examiner*—Thomas Denion
*Attorney, Agent, or Firm*—Morrison & Foerster, LLP

[57] ABSTRACT

A pair of rotors (1,3) includes tooth parts (7,9) with a cycloid tooth profile curve and tooth bottom pans (11,13), and are engaged with each other. A housing (2) includes rotor chambers (2a) for rotatably accommodating the rotors (1,3), a suction port and a delivery port. Tips of the tooth parts (7,9) of the rotors (1,3) respectively have top parts (15,17) with a predetermined arc length ($W_1$) which are cut to have a diameter ($D_2$) smaller than a diameter ($D_1$) of the tips of the predetermined cycloid tooth profile curve, and a diameter of the rotor chambers (2a) is made small.

11 Claims, 7 Drawing Sheets

FLUID MACHINE

BACKGROUND OF THE INVENTION

1. Field of the Invention

The present invention relates to a fluid machine for a super charger for vehicles, for example.

2. Description of Relevant Art

There is disclosed in Japanese Utility Model Registration Publication No. 3-548 a compressor of such a root-type as 201 in FIGS. 1 and 2. In Japanese Patent Application Laid-Open Publication No. 61-182483, there is disclosed a compressor of a similar type, like 301 in FIG. 3.

The compressor 201 of FIG. 1 includes a compressor casing 203 and a pair of rotors 205 and 207. The rotors 205 and 207 rotate in opposite directions to each other in a rotor chamber 209 formed in the casing 203. Fluid suction and delivery ports 211 and 213 are provided through The casing 203, substantially at fight angles to an axial direction of the rotors 205 and 207.

As shown in FIG. 2, in the compressor 201 a convex part 217 is provided by forming steps 215 on each top of the rotors 205 and 207, and a sealed portion is defined among the convex part 217, a mating rotor, and the rotor chamber 209.

The sealed portion has raised fluid resistance as well as loss head between the rotors 205 and 207 and between the rotors 205, 207 and the rotor chamber 209, thereby decreasing leakage of fluid back to the suction port 211 side, improving a volumetric efficiency of the compressor 201.

In the compressor 301 of FIG. 3, the involute-type rotors 305, 307 have their teeth each configured in a form by circumferentially expanding a circular arcuate part at a top of an inherent narrow tooth, with an identical radius, to have an enlarged length for a sealing relative to an inner circumference 303*a* of a compressor casing, achieving an improved sealing property between suction side 309 and delivery side 311.

However, in the compressor 201 of FIG. 1, as will be seen from FIG. 2, the sealed portion has an insufficient length (along the convex part 217), and a resultant sealing property is limited in improvement.

In the compressor 301 of FIG. 3, the expanded form of the arcuate pan is engaged with a corresponding depression 305*b*, 307*b* of the mutually engaging rotors 305, 307, and the depression 305*b*, 307*b* needs to be cut wider so that a resultant configuration is reduced in thickness at the depression 305b, 307b, where it has a failed strength.

SUMMARY OF THE INVENTION

The present invention has been achieved with such points in view. It therefore is an object of the invention to provide a fluid machine having an improved prevention of leakage from a delivery side to a suction side, securing strength of rotors.

To achieve the object, according to an aspect of the invention, there is provided a fluid machine comprising: a housing having a rotor chamber defined with first and second chamber walls arcuate about first and second rotation axes, respectively, and a pair of ports communicating with the rotor chamber; and first and second rotors adapted to rotate about the first and second rotation axes, respectively, cooperating with each other and with the first and second chamber walls to displace a volume of fluid between the pair of ports, the first rotor comprising first lobes interconnected by first depressions, the second rotor comprising second lobes interconnected by second depressions of which a respective one is egageable with a corresponding one of the first lobes, the corresponding first lobe being profiled at a top part thereof with a first connection curve and at lobed parts on both sides of the top part thereof with a first reference curve defined as one of cycloid and involute curves, the first connection curve residing radially inside the first reference curve.

According to this aspect of the invention, the respective second depression is allowed to have an equivalent or greater dimension than required for engagement with the first reference curve, and can have a sufficient strength. Moreover, the first connection curve is allowed to have a longer circumferential length, than a top of the first reference curve could have, for a sealing with the first chamber wall.

According to another aspect of the invention, the respective second depression is profiled at a bottom part thereof with a second connection curve and at depressed parts on both sides of the bottom part thereof with a second reference curve defined as one of cycloid and involute curves, the second connection curve residing radially outside the second reference curve.

According to this aspect of the invention, the second connection curve is allowed to cooperate with the first connection curve to provide an increased effective length for a sealing between the first lobe and the second depression.

Preferably, the first connection curve may comprise a circular arc. The second connection curve may preferably comprise a radially outwardly bulged central part, and a pair of side parts interconnected by the central part. The pair of side parts may preferably be radially inwardly reduced. Accordingly, a minute space may be enclosed between a combination of a circular central part of the first connection curve and either lobed part of the first rotor and a combination of the bulged central part of the second connection curve and either depressed part of the second rotor, within an angle range for either rotor to rotate, e.g., between from 7° to near 11° in the case of two rotors with two lobes.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
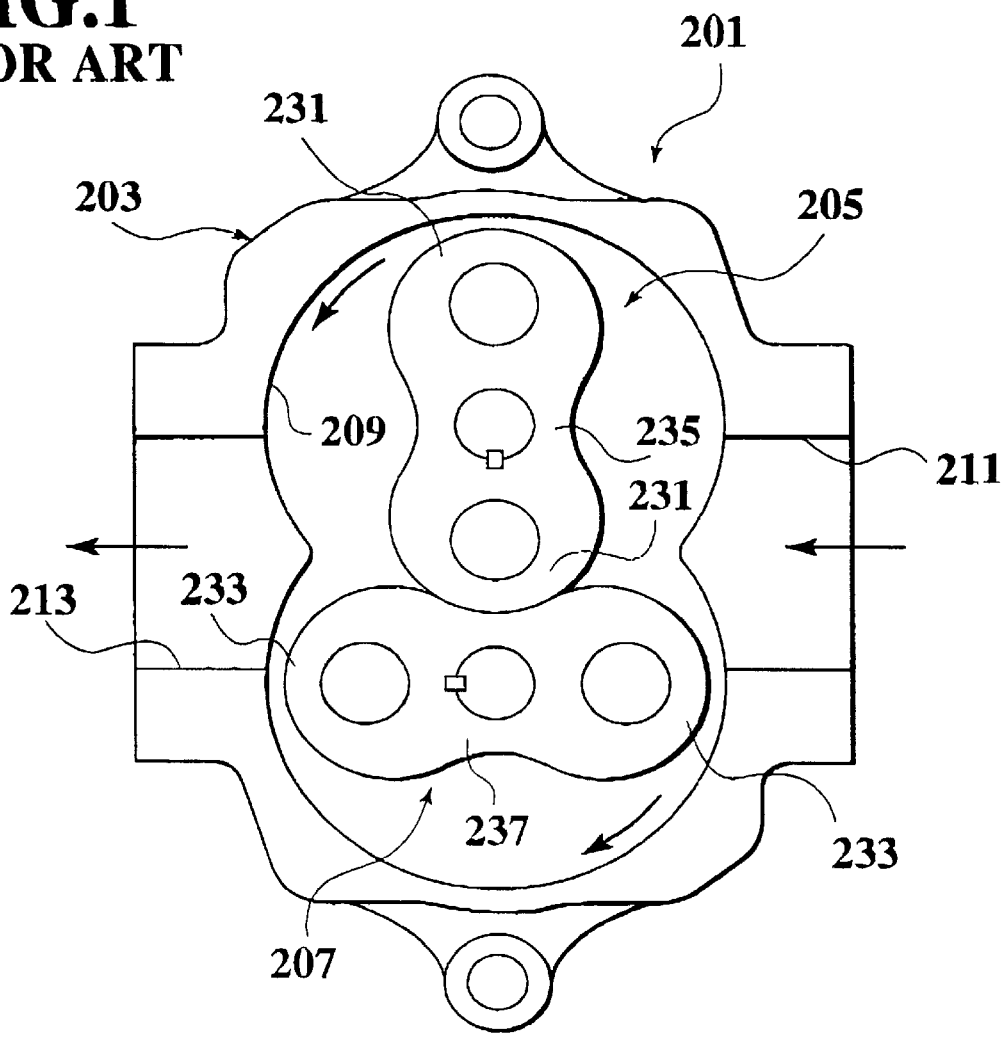
FIG.1 PRIOR ART
FIG. 1 is a section of a conventional example.
Figure 2:
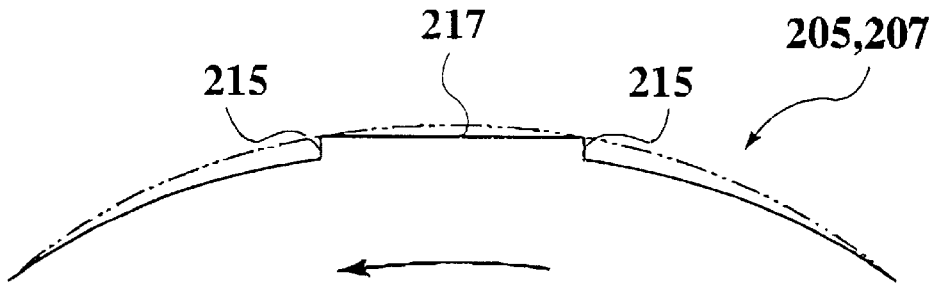
FIG.2 PRIOR ART
FIG. 2 is a partial detail of FIG. 1.
Figure 3:
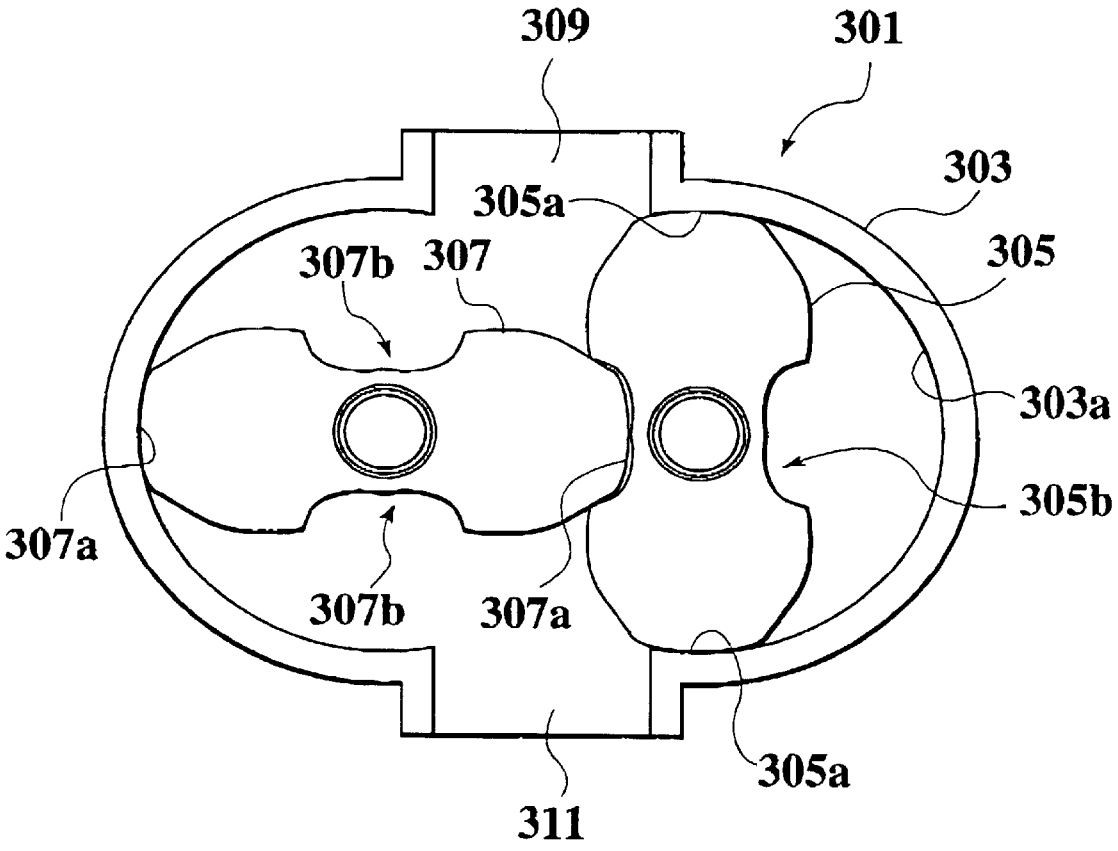
FIG.3 PRIOR ART
FIG. 3 is a section of another conventional example.

There will be detailed below the preferred embodiments of the present invention with reference to the accompanying drawings. Like members are designated by like reference characters.

Figure 4:
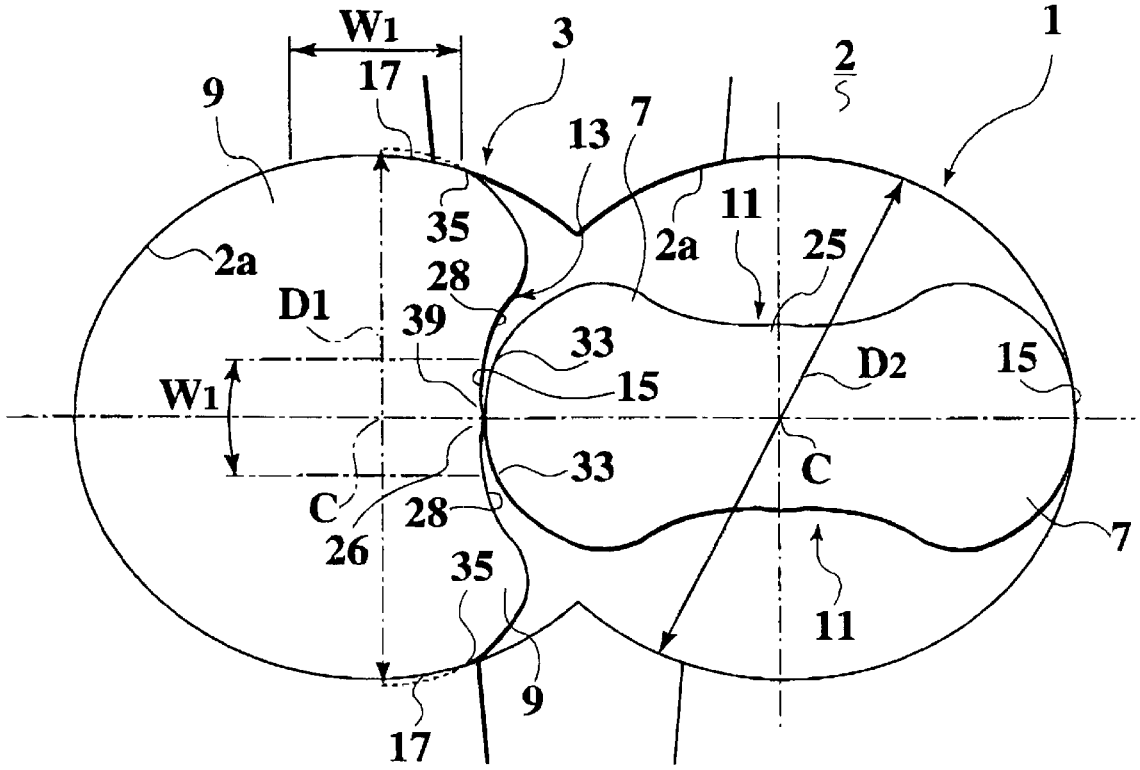
FIG. 4 is a sectional illustration describing an engaging sate of rotors of a fluid machine according to an embodiment of the invention.
Figure 5:
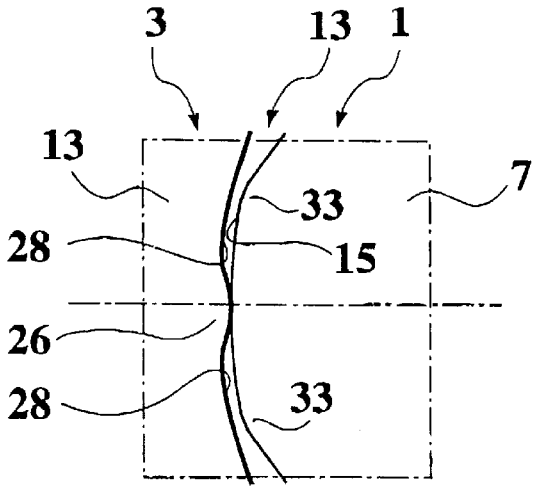
FIG. 5 is a partial detail of FIG. 4.
Figure 6:
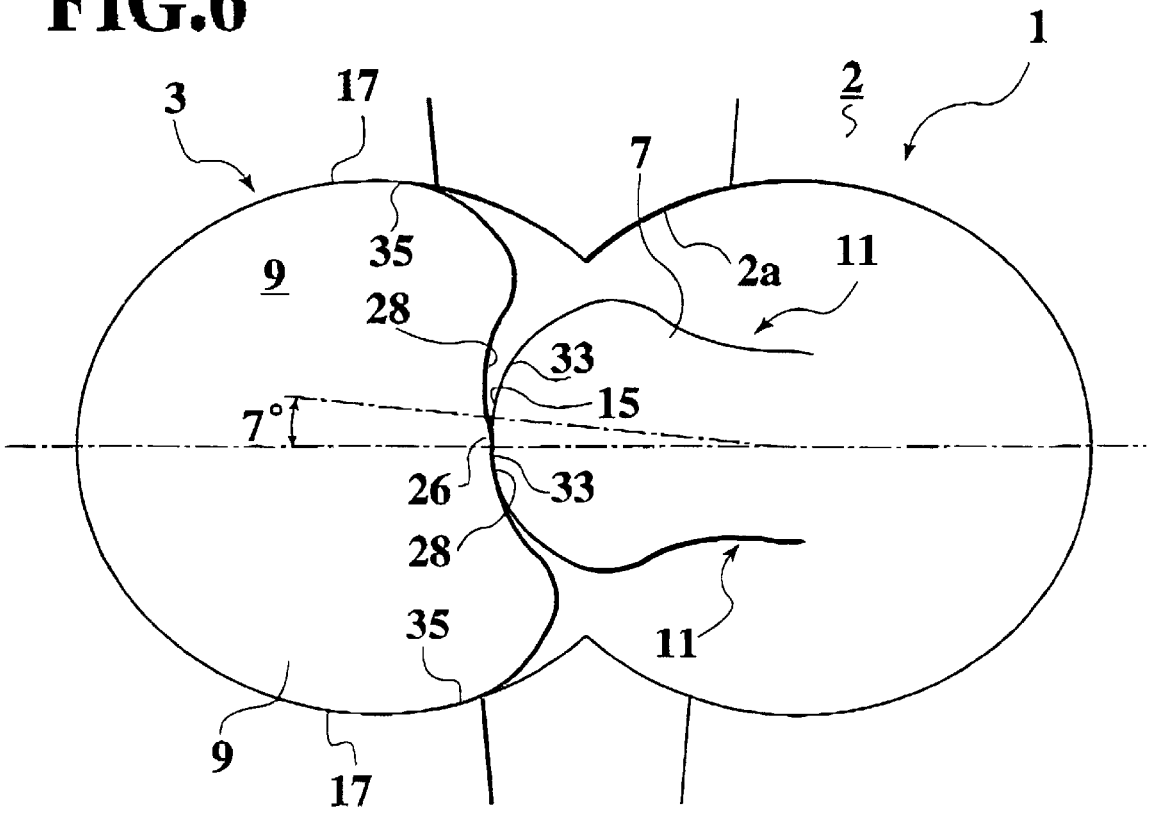
FIG. 6 is a sectional illustration describing another engaging state of the rotors of FIG. 4.
Figure 7:
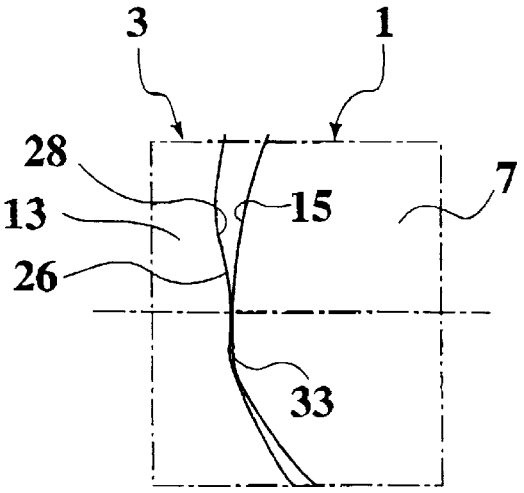
FIG. 7 is a partial detail of FIG. 6.
Figure 8:
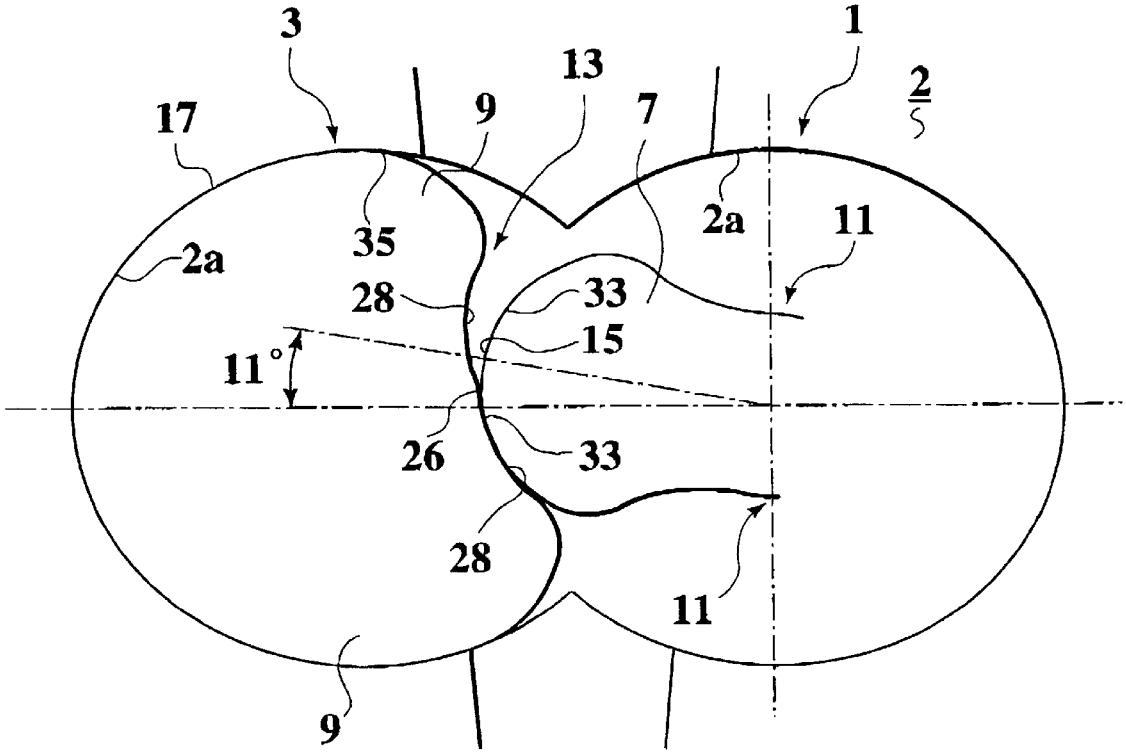
FIG. 8 is a sectional illustration describing another engaging state of the rotors of FIG. 4.
Figure 9:
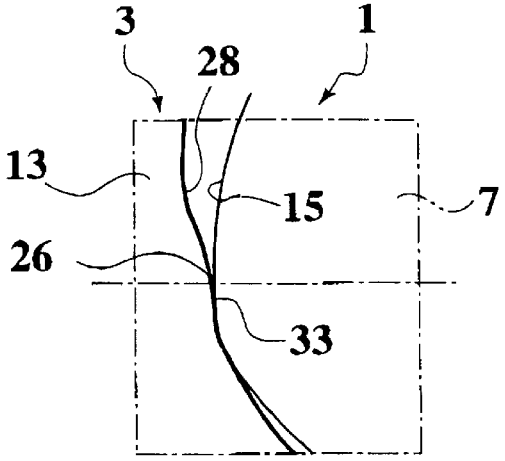
FIG. 9 is a partial detail of FIG. 8.

FIGS. 4 to 9, show a root type super charger as a fluid machine according to a first embodiment of the invention, in which FIGS. 4, 6, 8 describe varying states of engagement between a pair of rotors 1, 3 of the super charger. FIGS. 5, 7, 9 are detailed views.

As shown in FIG. 4, a rotor housing 2 of the super charger has a rotor chamber consisting of a pair of left and right mutually communicating rotor chambers 2*a*, which are defined with left and right arcuate chamber walls circular about left and right mutually parallel rotation axes C, respectively, and with front and left flat side walls of corresponding configurations. The left and right chamber walls 2*a* each have an identical bore diameter $D_2$. The rotors 3 and 1 are accommodated in the left and right rotor chambers 2*a,* respectively, and are fixed in position on left and right drive shafts (not shown) rotatable about the rotation axes C, respectively, and adapted to be synchronously driven to rotate in opposite directions, by a combination (not shown) of an engine and timing gears. When driven, the left and right rotors 1, 3 cooperate with each other and with the arcuate circumferential walls and flat side walls of the left and right rotor chambers 2*a,* to displace a volume of fluid from a relatively wide suction port to a relatively narrow delivery port. Thc suction and delivery ports communicate with the chambers 2*a*. During mutual engagement, the rotors 1, 3 are kept intact from each other, with a specified very small clearance between several micrometers to tens of micrometers in the case of super chargers for automobiles. The small clearance between rotors, as well as those between the rotors and chamber walls, is responsible for fluid resistance (and associated head loss) between the suctions side and the delivery side. The fluid resistance is proportional to a length of the clearance.

The rotors 1 and 3 are identical to each other in longitudinal profile, and each have a pair of tooth parts 7, 9 as their lobes and a pair of tooth bottom parts 11, 13 as their depressions therebetween. Unless otherwise described herein, the respective parts 7, 9, 11, 13 are profiled along predetermined plane-symmetric reference curves as basic tooth profiles to be mathematically defined by corresponding cycloid curves. The reference curves may be involute curves.

As shown in FIG. 4, the tooth parts 7 and 9 of the rotors 1 and 3 are formed such that tip parts of the basic tooth profile (predetermined diameter $D_1$) formed by a cycloid curve is cut to be reduced to the diameter $D_2$, and arcuate top parts 15 and 17 formed by the cutting have a predetermined arc length $W_1$. The rotor chambers 2*a* of the housing 2 are formed small so that their hole diameter becomes ($D_2$ +predetermined gap between the tips on both sides) according to the cut amount of the tip parts of the rotors 1 and 3.

The tooth profile of the tooth parts 7 and 9 of the rotors 1 and 3 is determined such that their top parts 15 and 17 constitute arcs of the length $W_1$ about an axis C, and the cycloid curve tooth profile parts (left uncut) are connected to the arcs at connection points 33 and 35.

The shape of the tooth bottom parts 11 and 13 of the rotors 1 and 3 is configured such that the top parts 15 and 17 of the tooth parts 7 and 9 are engageable synchronously with the cycloid curve tooth profile parts connected with the top parts 15 and 17 while minute and uniform gaps are maintained therebetween, and as shown in FIG. 4, convex parts 26 are formed respectively on central portions of the tooth bottom parts 11 and 13 and concave parts 28 are formed respectively on both sides of the convex parts 26.

There will be detailed below functions of the rotors 1 and 3.

The rotors 1 and 3 are assumed to be rotating synchronously by the engine via the timing gear while the predetermined gaps are maintained between the rotors 1 and 3, between the rotors I and 3 and the rotor chambers 2a of the housing 2 and between the rotors 1 and 3 and side walls of the housing 2.

FIG. 4 shows a state in which the rotors I and 3 are engaged with each other at right angles, and FIGS. 6 and 7 show a state in which the rotor 1 is rotated at an angle of 7° in a clockwise direction and the rotor 3 is rotated at an angle of 7° in a counterclockwise direction. Moreover, FIGS. 8 and 9 show a state in which the rotors 1 and 3 are rotated CW and CCW at an angle of 11° . As the rotation angle increases from the right-angled engagement to the 7° and 11° angles, the gap between the rotors 1 and 3 at the engagement start side (the delivery side in lower-half of the figures) becomes narrower gradually.

As shown in FIGS. 6 and 7, when the rotation angle of the rotors 1 and 3 is around 7°, the tooth pants 7 and 9 of the rotors I and 3 are engaged with the tooth bottom parts 13 and 11, and suction air is eliminated completely, which means an enclosed space (pocket part) between the rotors 1 and 3 becomes extremely minute, and the same state is maintained while the rotation angle of the rotor I resides within a range between around 7° to around 11°. A continuous configuration of the convex parts 26 formed on the tooth bottom parts 11 and 13 of the rotors I and 3 and the concave parts 28 formed on both sides of the convex parts 26 is obtained so that the synchronous engagement is obtained with the minute and constant gap maintained between the top parts 15 and 17 of the rotors 1 and 3 and the cycloid curve part, as described, and the sealing property is improved in free of seizure due to interference between the rotors 1 and 3.

As a sealed portion whose arc has the length of $W_1$ is formed on the top pans 15 and 17 of The rotors 1 and 3, the air leakage from the delivery side to the suction side is prevented.

Meanwhile, since the convex part 26 is formed on the central portion of the tooth bottom parts 11 and 13 of the rotors 1 and 3 and the gentle shallow concave parts 28 are formed on its both sides, a portion with a thin thickness is not generated, and the strength of the rotors 1 and 3 is secured sufficiently.

According to the present embodiment, since the outer diameter portion of the cycloid curve tooth profile of the rotors 1 and 3 is corrected so as to have an arc shape, the sealed portion having sufficient arc length is easily formed on the top parts 15 and 17. As a result, the leakage-preventing performance and the volumetric efficiency are improved.

In addition, as the tooth tip parts of the rotors 1 and 3 are cut so as to have a small diameter and the arcuate top parts 15 and 17 having a predetermined length are formed, the present embodiment is different from the above-mentioned second conventional example in which the arc length is simply set to be longer, and the depression of the tooth bottom parts 11 and 13 can be made smaller, and sufficient strength can be secured.

In addition, as the top parts 15 and 17 are formed into an arc shape coaxially, the process is easy.

The arc length W1 of the top part 15 may be reduced small, with a corresponding reduction in size of the convex part 26 and concave parts 28, 28 of each tooth bottom part 11, 13, so long as the leakage prevention property is effective.

Figure 10:
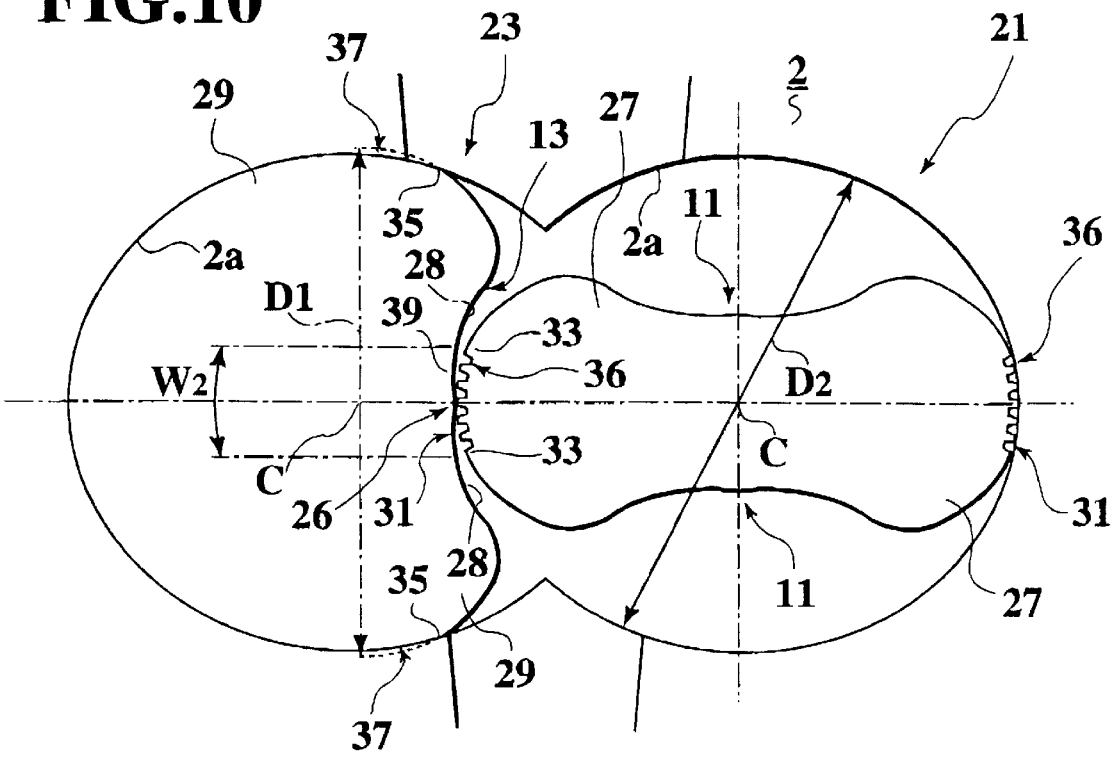
FIG. 10 is a sectional illustration describing an engaging state of rotors of a fluid machine according to another embodiment of the invention.
Figure 11:
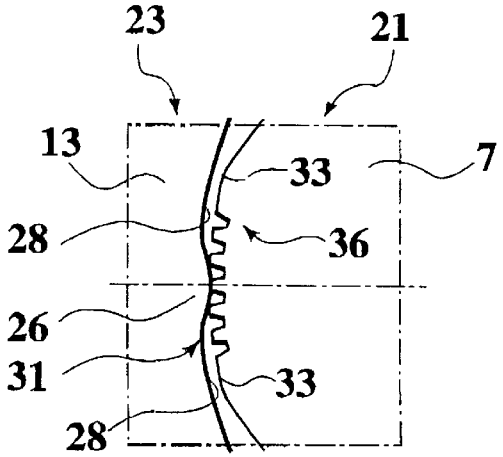
FIG. 11 is a partial detail of FIG. 10.

There will be described a root type super charger as a fluid machine according to a second embodiment of the invention, with reference to FIGS. 10 and 11. FIG. 10 shows a state of engagement between rotors of the super charger. FIG. 11 is an partial detail. This super charger is different from that of first embodiment in that labyrinth grooves are formed in arcuate top parts of rotor tooth parts.

As shown in FIGS. 10 and 11, a plurality of axially extending labyrinth grooves 31 of an identical section are formed in arcuate top parts 36 and 37 of tooth parts 27 and 29 of rotors 21 and 23.

The labyrinth grooves 31 provides an increased effect for leakage prevention between the tooth parts 27 and 29 and tooth bottom parts 13 and 11 of the rotors 21 and 23 and between the tooth parts 27 and 29 of the rotors 21 and 23 and rotor chambers 2a of the housing 2. The labyrinth of the grooves 31 is additionally effective for the leakage prevention.

As the rotors 21 and 23 are formed by cutting the outer diameter portion of the cycloid curve tooth profile into an arc shape, an arcuate range where the labyrinth grooves 31 are formed can be enlarged, and thus a leakage can be prevented efficiently.

The labyrinth grooves may have an arbitrary shape, if necessary.

Figure 12:
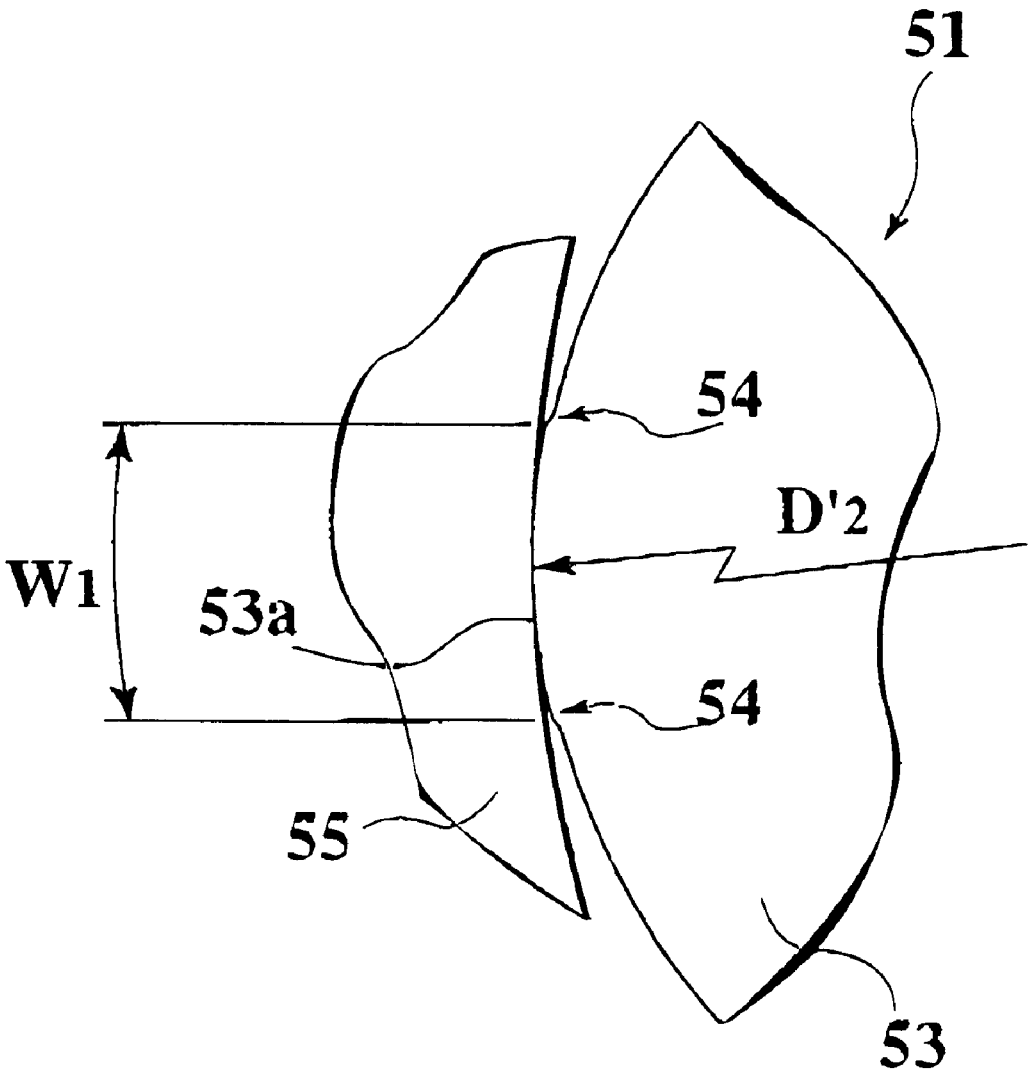
FIG. 12 is a sectional illustration of a top part of a rotor of a fluid machine according to another embodiment of the invention.

There will be detailed below a root type super charger as a fluid machine according to a third embodiment of the invention, with reference to FIG. 12. This figure shows a top part of a lobe of a rotor and an inner periphery of a rotor chamber in a rotor housing of the super charger. This embodiment is different from the first embodiment in configuration of arcuate top parts of rotor tooth parts.

A rotor 51 is cut by a predetermined amount until an outer diameter (top vertex) of a tooth 53 of a cycloid tooth profile (for example, outer diameter =DI in FIG. 4) has a diameter $D_2'$, whereby an arcuate top part 53*a* is formed coaxial with a rotor axis. The arc of the top part 53*a* is thus expanded to a predetermined length $W_1$. In other words, the top part 53*a* formed by cutting the predetermined amount is provided at both ends thereof with pad-like parts of an even size, before expanding this top part 53*a* with the same radius as the existing top part 53*a*.

Then, the diameter of a rotor chamber in the housing 55 for accommodating the rotor 51 is sized to a corresponding dimension to the radius of the top part 53*a*.

According to this embodiment, the cutting amount of the tooth part 53 of the rotor 51 is set smaller than in the first embodiment, and pad-like parts 54 are formed at both ends of the top part 53*a* after the cutting, to provide the top part 53*a* with a necessary length.

As a result, there are achieved like sealing effects to the first embodiment, in addition to that a minimized cutting at an outside-diameter portion of the tooth part 53 is advantageous for a delivery rate to be secured.

The top part 53*a* of the rotor 51 as well as a top part of a mating rotor may preferably be formed with labyrinth grooves to provide the more improved sealing property.

The foregoing embodiments are addressed to a rotor having a pair of lobes. They may preferably be applied to a rotor having a plurality of lobes interconnected by depressions, whether the lobes are axially straight or spiral, or whether their lobed or depressed parts are cycloid or involute.

According to the embodiments described, there is provided a root type super charger as a fluid machine comprising: a housing (2; 55) having a rotor chamber (2*a*+2*a*) defined with right and left arcuate chamber walls (2*a*, 2*a*) circular about right and left rotation axes (C, C), respectively, a suction port (upside port in FIGS. 4, 10) communicating with the rotor chamber (2*a*+2*a*), and a delivery port (downside port in FIGS. 4, 10) communicating with the rotor chamber (2*a*+2*a*); and right and left rotors (1, 3; 21, 23; 51) adapted to rotate about the right and left rotation axes (C, C), respectively, cooperating with each other and with the right and left chamber walls (2*a*, 2*a*) to displace a volume of fluid between from the suction port to the delivery port, the right rotor (1; 21; 51) comprising first lobes (7, 7; 27, 27, 29, 29; 53) interconnected by first depressions (11, 11), the left rotor (3; 23) comprising second lobes (9, 9; 29, 29) interconnected by second depressions (13, 13) of which a respective one (13) is egageable with a corresponding one (7; 27; 29; 53) of the first lobes (7, 7; 27, 27, 29, 29; 53), the corresponding first lobe (7; 27; 29; 53) being profiled at a top part thereof with a first connection curve (15; 36; 53*a*) and at lobed parts (33, 33) on both sides of the top part thereof with a first reference curve defined as one of cycloid and involute curves, the first connection curve (15; 36; 53a) residing radially inside the first reference curve. The respective second depression (13) is profiled at a bottom part thereof with a second connection curve (28+26+28) and at depressed parts (outside of 28) on both sides of the bottom part thereof with a second reference curve defined as one of cycloid and involute curves, the second connection curve (28+26+28) residing radially outside the second reference curve. The first connection curve comprises a circular arc. The second connection curve comprises a radially outwardly bulged central part (26), and a an pair of side parts (28, 28) interconnected by the central part (26). The pair of side parts (28, 28) are radially inwardly reduced.

I an aspect of the embodiments, a fluid machine comprises: a pair of rotors each having a plurality of lobed tooth parts with a predetermined tooth profile curve, and depressed tooth bottom parts formed between respective lobed tooth parts, the rotors being engageable with each other, as they rotate; and a housing having a rotor chamber containing the rotors to be rotatable, and fluid suction and delivery ports, wherein tips of the tooth parts of the rotors each have an arcuate top part of a predetermined length cut with a smaller radius than a tooth tip radius of the predetermined tooth profile curve, and the rotor chamber is formed small in accordance with the cutting of the rotors.

Accordingly, a sealed portion with a sufficient length can be formed between the arcuate top parts of the tips of the rotors and the rotor chambers, and a sealing property between the delivery port and the suction port is improved, and the volumetric efficiency is improved. In addition, the above structure is different from a structure where a sealed portion is enlarged by forming an arc part to have the same radius as a tip of a predetermined tooth profile, and since in the above structure the tip is cut to have a small radius, the process for forming the arc part is easy.

In another aspect, a fluid machine comprises: a pair of rotors each having a plurality of lobed tooth parts with a predetermined tooth profile curve, and depressed tooth bottom parts formed between respective lobed tooth parts, the rotors being engageable with each other, as they rotate; and a housing having a rotor chamber containing the rotors to be rotatable, and fluid suction and delivery ports, wherein tips of the tooth parts of the rotors each have an arcuate top part cur with a smaller radius than a tooth tip radius of the predetermined tooth profile curve, and a length of the top part is extended to a predetermined length by providing pads at both ends of the arcuate top part.

Accordingly, a sealed portion with a sufficient length can be formed between the arcuate top parts of the rotors and the rotor chambers, and the length of the top parts is extended to a predetermined length by padding both the ends of the arcuate top parts. As the cutting amount can be reduced, the radius of the arcuate top parts can be increased, and this structure is advantageous for a delivery quantity to be secured.

The arcuate top part can be cut with easy, by a lathe for example. The padding may be formed, e.g., by a processing with its thickness inclusive, such as when processing a predetermined tooth profile curve (cycloid or involute) with a numeric control machine, or by an injection molding or casting of a configuration including the thickness.

In another aspect, the fluid machine is a root type in which the tooth parts and the tooth bottom parts of the rotors each have a predetermined cycloid curve as a basic tooth profile thereof. Accordingly, the strength of the rotors can be secured sufficiently by correcting the tips of the tooth parts of the basic cycloid curve tooth profile and the tooth bottom parts.

In another aspect, the rotors have grooves formed in the top parts. Accordingly, due to the grooves in the rotors, the sealing property between the delivery port and the suction port is further improved.

While preferred embodiments of the present invention have been described using specific terms, such description is for illustrative purposes, and it is to be understood that changes and variations may be made without departing from the spirit or scope of the following claims.

What is claimed is:

1. A fluid machine comprising:

a housing having a rotor chamber defined with first and second chamber walls arcuate about first and second rotation axes, respectively, and a pair of ports communicating with the rotor chamber; and first and second rotors adapted to rotate about the first and second rotation axes, respectively, cooperating with each other and with the first and second chamber walls to displace a volume of fluid between the pair of ports, the first rotor comprising first lobes interconnected by first depressions, the second rotor comprising second lobes interconnected by second depressions of which a respective one is egageable with a corresponding one of the first lobes, the corresponding first lobe being profiled at a top pan thereof with a first connection curve and at lobed parts on both sides of the top part thereof with a first reference curve defined as one of cycloid and involute curves, the first connection curve residing radially inside the first reference curve.

2. The fluid machine as claimed in claim 1, wherein the respective second depression is profiled at a bottom part thereof with a second connection curve and at depressed parts on both sides of the bottom part thereof with a second reference curve defined as one of cycloid and involute curves, the second connection curve residing radially outside the second reference curve.

3. The fluid machine as claimed in claim 1, wherein the first connection curve comprises a circular arc.

4. The fluid machine as claimed in claim 2, wherein the second connection curve comprises a radially outwardly bulged central part, and a pair of side pans interconnected by the central part.

5. The fluid machine as claimed in claim 4, wherein the pair of side parts are radially inwardly reduced.

6. A fluid machine comprising: a pair of rotors each having a plurality of lobed tooth parts with a predetermined tooth profile curve, and depressed tooth bottom parts formed between respective lobed tooth parts, the rotors being engageable with each other, as they rotate; and a housing having a rotor chamber containing the rotors to be rotatable, and fluid suction and delivery ports, wherein tips of the tooth parts of the rotors each have an arcuate top part of a predetermined length cut with a smaller radius than a tooth tip radius of the predetermined tooth profile curve, and the rotor chamber is formed small with respect to a cut of the rotors.

7. A fluid machine comprising: a pair of rotors each having a plurality of lobed tooth parts with a predetermined tooth profile curve, and depressed tooth bottom parts formed between respective lobed tooth pans, the rotors being engageable with each other, as they rotate; and a housing having a rotor chamber containing the rotors to be rotatable, and fluid suction and delivery ports, wherein Tips of the tooth parts of the rotors each have an arcuate top part cut with a smaller radius than a tooth tip radius of the predetermined tooth profile curve, and a length of the top part is extended to a predetermined length by providing pads at both ends of the arcuate top part.

8. A fluid machine according to claim 6, wherein the fluid machine is a root type in which the tooth parts and the tooth bottom parts of the rotors each have a predetermined cycloid curve as a basic tooth profile thereof.

9. A fluid machine according to claim 7, wherein the fluid machine is a root type in which the tooth parts and the tooth bottom parts of the rotors each have a predetermined cycloid curve as a basic tooth profile thereof.

10. The fluid machine as claimed in claim 6, wherein the rotors have grooves formed in the top parts.

11. The fluid machine as claimed in claim 7, wherein the rotors have grooves formed in the top parts.

* * * * *